US005696361A

United States Patent [19]

Chen

[11] Patent Number: 5,696,361

[45] Date of Patent: Dec. 9, 1997

[54] MULTI-DUCTS SOUND ELIMINATOR FOR AIR PIPE

[76] Inventor: Chia-Hsien Chen, 2Fl., No. 3, Alley 16, Lane 235, Pao-Chiao Rd., Hsin Tien City, Taipei Hsien, Taiwan

[21] Appl. No.: 558,281

[22] Filed: Nov. 13, 1995

[51] Int. Cl.[6] ..... E04F 17/04

[52] U.S. Cl. ..... 181/224; 181/256; 181/257

[58] Field of Search ..... 181/224, 229, 181/230, 250, 251, 252, 256, 257, 258, 264, 268, 275, 238, 239

[56] References Cited

U.S. PATENT DOCUMENTS

| | | | |
|---|---|---|---|
| 3,726,359 | 4/1973 | Dierl et al. | 181/224 |
| 3,854,548 | 12/1974 | Suzuki | 181/224 |
| 4,105,089 | 8/1978 | Judd | 181/264 |
| 4,180,141 | 12/1979 | Judd | 181/264 |
| 4,236,597 | 12/1980 | Kiss et al. | 181/224 |
| 5,365,025 | 11/1994 | Kraai et al. | 181/252 X |

*Primary Examiner*—Khanh Dang
*Attorney, Agent, or Firm*—Bacon & Thomas

[57] ABSTRACT

A multi-duct sound eliminator for an air pipe which can be installed din the air inlet or outlet of an air or gas pipe in order to eliminate noise. The outer casing of the sound eliminator can be made in cylindrical shape, a rectangular shape, or a flat shape. The round ducts are arranged in high density matrix to facilitate air flow. For high speed and high temperature air, the sound eliminator uses ducts with air holes covered with metal net, or glass fiber cloth in order to increase the sound absorbing of low frequency noise. Between each duct, sound-absorbing cotton is placed. The ducts are covered by multi-layers of netting material which stack together to prevent the sound-absorbing cotton from being washed out by high speed air flow. For lower speed and lower temperature air, the air channel uses molded sound-absorbing foam to form one unit in which is installed the multi-ducts in order to expand the effectiveness of sound eliminating on low frequency noise.

3 Claims, 6 Drawing Sheets

MULTI-DUCTS SOUND ELIMINATOR FOR AIR PIPE

BACKGROUND OF THE INVENTION

1. Field of the Invention

The present invention relates to a multi-duct sound eliminator for the air inlet and outlet of an air pipe in order to eliminate noise.

2. Description of the Prior Art

Currently sound is eliminated in an air pipe by sound-absorbing material on the outer casing of the pipe, which is called an additional covering air pipe. When air flows through this additional covering air pipe, part of the noise will be absorbed by the sound- absorbing material. Generally, since the air pipe has a specified diameter, the covering can only eliminate part of noise. Thus, the effectiveness of noise reduction is very limited. As regular sound-absorbing materials are mineral cotton which has specific density, the ability to eliminate the noise is limited. Especially at a bending point, a divided point and a gate of air pipe, the decibel of noise is very high and will cause the vibration of the air pipe to distribute radiated noise throughout the neighborhood. The general solution is to add several sound-absorbing boards in the air pipe in parallel in order to additionally reduce the noise. However, this method increases the quantity of sound-absorbing material and the sound-absorbing area in order to have a higher noise reduction rate. However, using this method produces a sound eliminator under the same noise reduction rate that will require a very large volume pipe, but the effectiveness is not as good as predicted.

As FIG. 8 shows, the conventional technique for a sound eliminator of an air pipe, is to put several sound-absorbing boards in the pipe in parallel in order to partition it into several air channels. When air flows through the air channels, the sound- absorbing board will eliminate part of the noise. Each parallel sound-absorbing board requires a specific thickness. An air pipe sectional area has a fixed length and width, and the number of sound-absorbing boards that can be installed is also fixed. Under this model, the noise reduction rate is in direct proportion to the ratio of the channels overall circumference and the channel sectional area. Therefore, the structure of a conventional air pipe almost always use square pipes, which require more space and the effectiveness of sound-absorbing is limited.

On the other hand, U.S. Pat. No. 4,236,597 uses one air-flow duct as one unit of a matrix structure used in the transmission of ventilating air. A mass sound-absorbing material covers on the outside of the air-flow duct, with a prismatic elongated casing to form a square pillar. It uses flat boards to enhance the support, for several large diameter (more than 10") air-flow ducts.

However, the present invention setup is for small diameter (½" to 4") air-flow ducts. The present invention has been carefully calculated to change the structure of the air-flow ducts under the same sectional area and the same air flow. The present invention uses the same quantity of sound-absorbing cotton as the conventional sound eliminator, but has two times the effectiveness of sound-absorbing. The conventional sound eliminator is only installed in several air-flow ducts which will affect the sound-absorbing surface area. However, the present invention can be installed around hundreds of air-flow ducts. The more the quantity and the longer the air-flow ducts, the higher the effectiveness. The conventional sound eliminator for an air pipe needs to have a very long structure in order to have the same effectiveness as the present invention. The present invention can save half of the overall dimension of the air pipe, and use high density multi air-flow ducts to eliminate resonance and noise, and achieve low cost in order to reduce the noise on and between the air pipes.

Moreover, U.S. Pat. No. 4,180,141 claims one distributor for gas turbine silencers, a housing in which numerous tubes are vertically supported evenly spaced and separated from each other. The tube may metal or other strong structural material, having a fiber or form-like filler (porous, foamy, asbestos, glass, rock fiber) and perforated by perforations. Such a structure is similar U.S. Pat. No. 4,236,597. However, the arrangement of the air-flow ducts and the design of present invention achieves better effectiveness than the above designs.

SUMMARY OF THE INVENTION

The purpose of the present invention is to provide a multi-duct sound eliminator which uses a special structure to reduce the noise in the air pipe. It uses several small diameter air-flow ducts in a matrix and in a dense arrangement in the air pipe. Each air-flow duct is covered with glass fiber cloth and stainless steel net, and sound-absorbing cotton is placed around the space between each air-flow duct. The air intake from the air inlet passes to an expandable room in order to flow to each duct evenly. The noise will be reduced while it reflects among each duct. Thus, the noise of air will be greatly reduced in order to provide two times the noise reduction rate of the conventional sound eliminator with the same length and width of outer casing under the same sectional area, same length of air channel, and the same quantity of sound-absorbing cotton. Under the same volume of sound-absorbing cotton, the inner surface area of the air channel of the present invention is two times the conventional sound eliminator. Besides, the prevent invention can have sound-absorbing foam to make multi-duct in one unit for low speed air flow with the same effectiveness.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
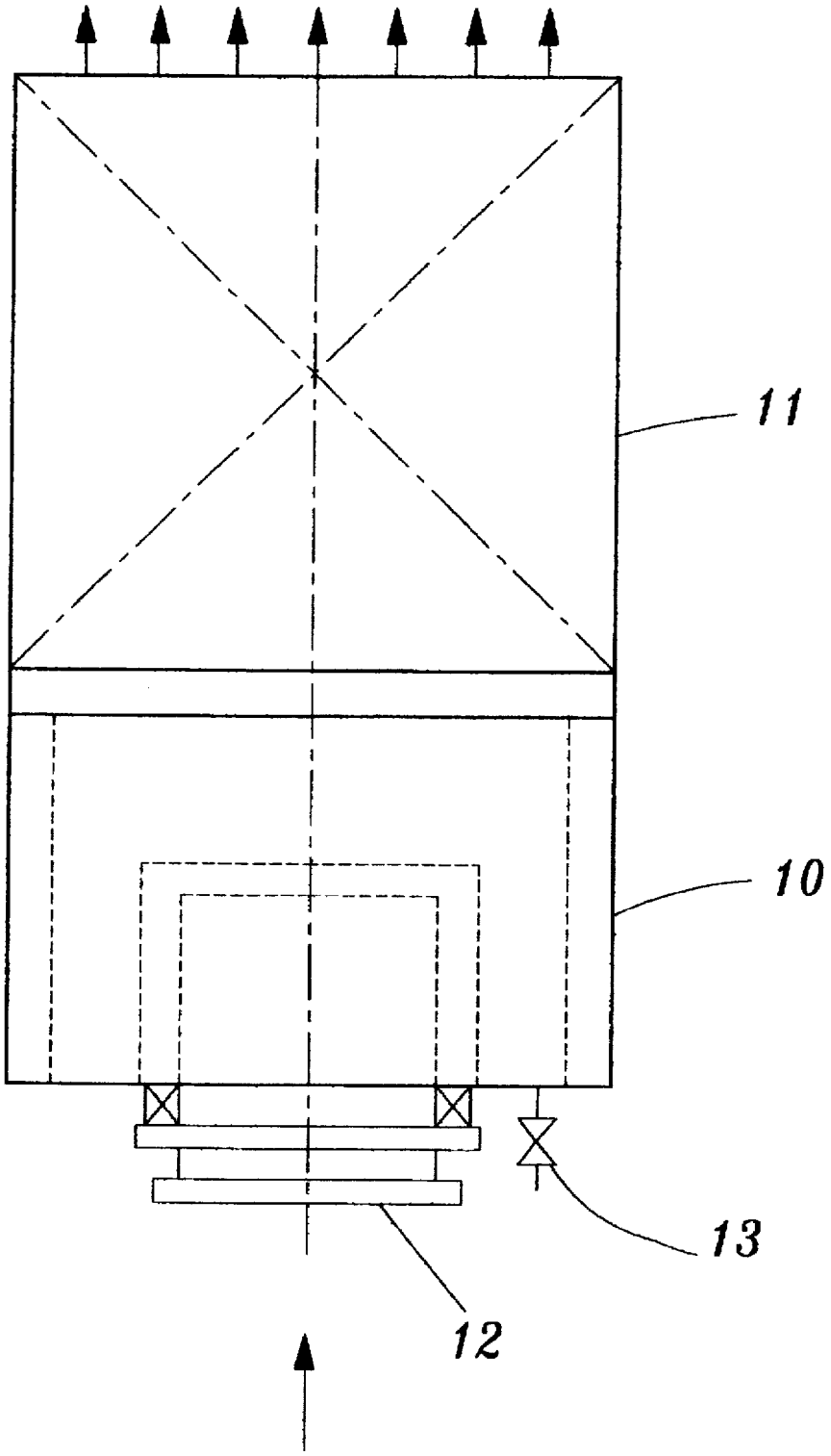
FIG. 1 is an elevational view of the present invention.
Figure 2:
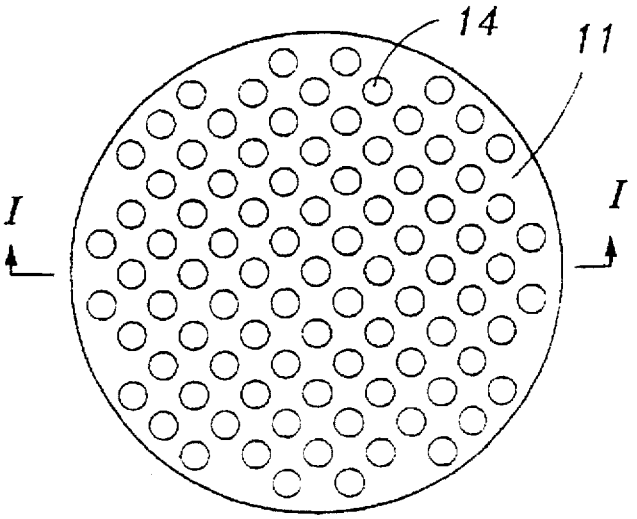
FIG. 2 is a sectional view of the outer casing of the round pipe of the present invention.
Figure 3:
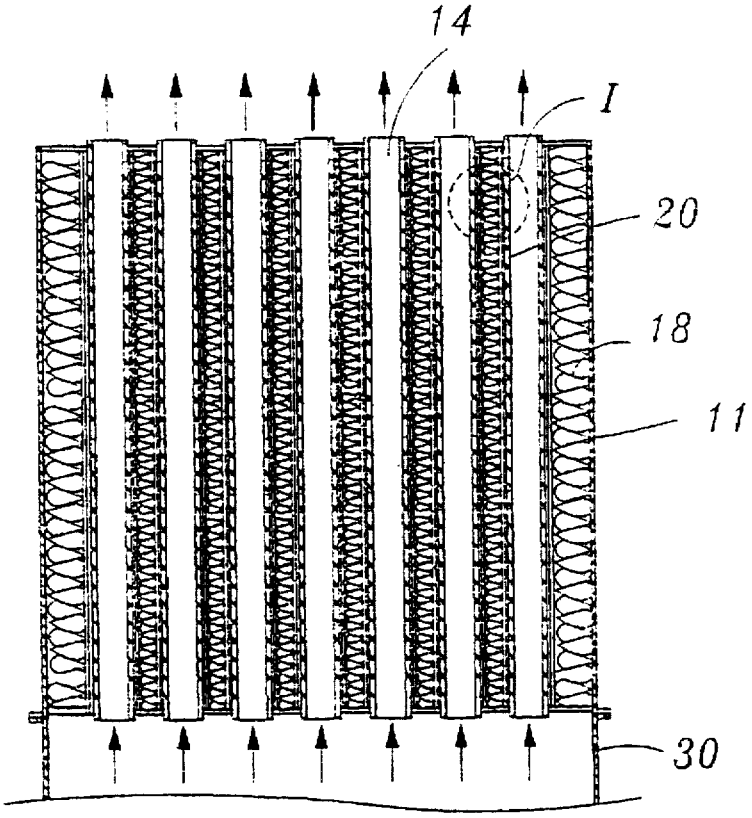
FIG. 3 is a sectional view taken along line I—I of FIG. 2 of the present invention.
Figure 4:
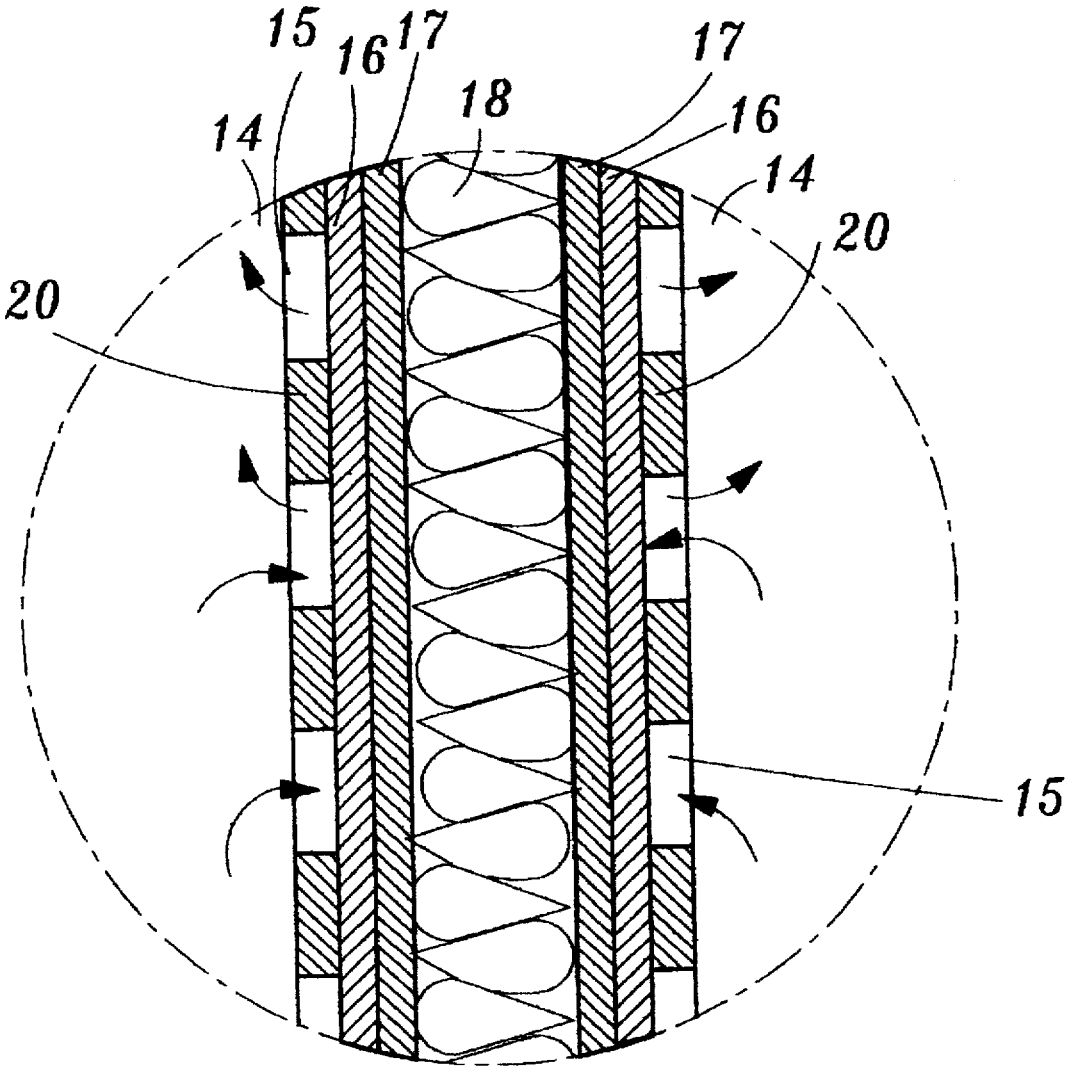
FIG. 4 is an enlarged view of area B part of FIG. 3 of the present invention.

As per FIG. 1, the present invention is installed behind air inlet 12 of the air pipe or in front of the outlet of the air pipe. Plenum 10 is adjacent to the outer casing 11 of sound eliminator. There is a drip switch 13 on the pipe wall near the air inlet in order to drain the water from air. As shown on FIG. 2, the sound eliminator has a special structure in order to reduce the noise in the pipe. There are several ducts 14 in matrix arrangement in the round outer casing of the sound eliminator. The duct wall of each of duct 14 has a plurality of holes 15. As shown in FIG. 3 and FIG. 4, there is a space between two adjacent ducts 14. One layer of stainless steel net 16 and one layer of glass fiber cloth 17 extend around the outside of each duct 14. Sound-absorbing cotton 18 fills the space between air-flow ducts 14 in the outer easing 11. When air flow from the air inlet 12 flows to the plenum 10 for expansion, air will go through each duct 14, and the noise waves will pass in and out continuously in each hole 15. Some noise waves will move forward along the duct wall. Some noise waves will enter the front hole and turn to the siding of sound-absorbing cotton 18. Thus the energy of noise waves will be absorbed by the sound-absorbing cotton to reduce the noise of air flow. Under the same sectional area of overall air-flow ducts, the present invention increases the quantity ducts to increase the ratio of the overall circumference of the air channel the sectional area. This is the main characteristic of the present invention. The outer casing can be made in cylindrical shape, rectangular shape or flat shape according to the actual requirements. The present invention is adapted to ducts of less than five inches.

Each duct is arranged regularly, and fixed in position inside the outer casing. As shown in the bottom section of FIG. 3 and FIG. 5, a protruding part 30 has some distance between the front of air inlet and the sound eliminator of the present invention. As the main body is a cylindrical shape, there is a bottom board on the air outlet to fix the air outlet of the pipe. It also can be an ending board to fix the air outlet of the pipe. When the air-flow ducts have been installed, the sound-absorbing cotton is placed into the space between the ducts, and then the top board and the joint are sealed.

Figure 5:
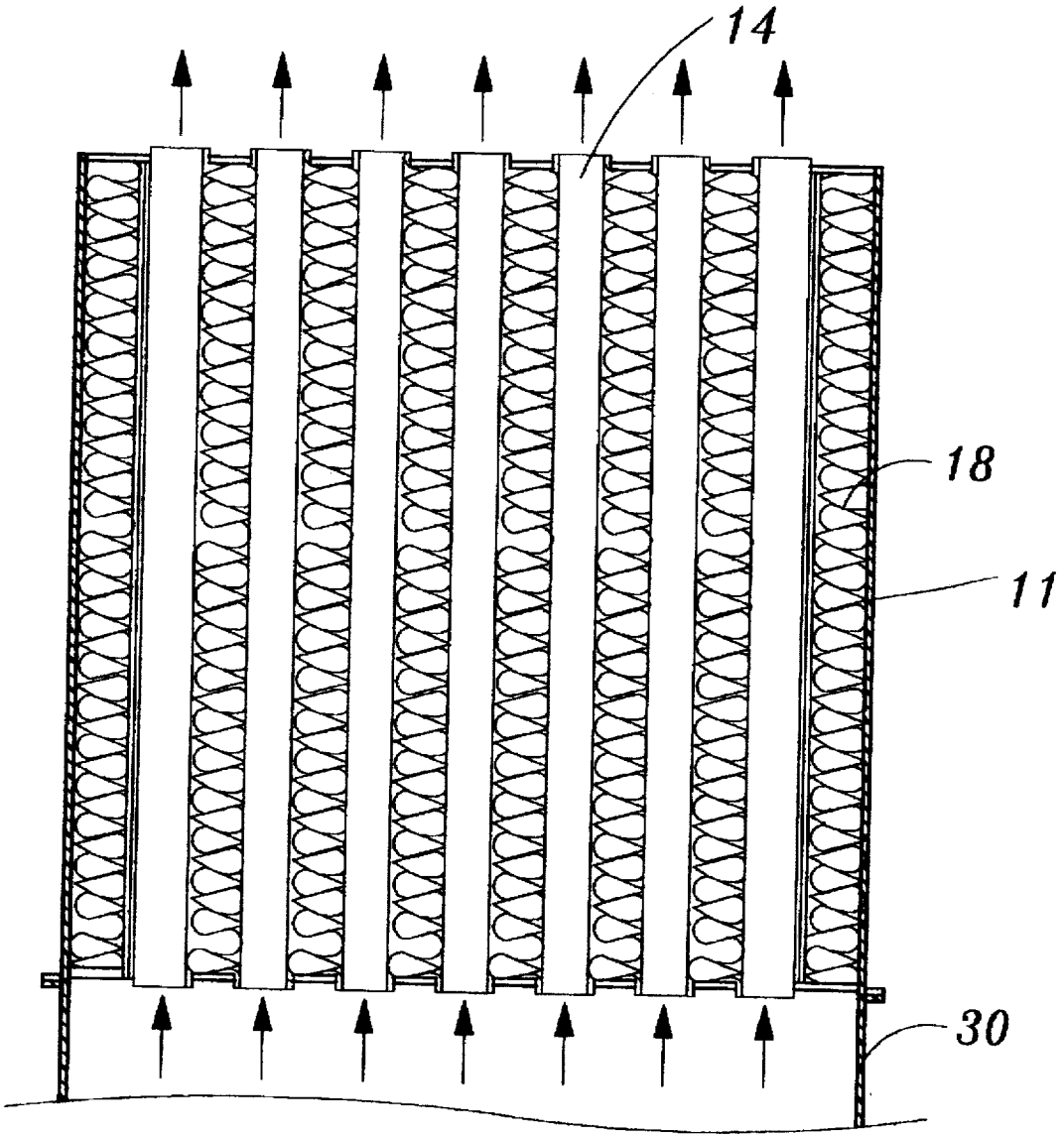
FIG. 5 is a sectional view of an example of the present invention.

The present invention also has another simple example. As shown in FIG. 5, it eliminates the multi-ducts facility to be one unit of a duct. The duct uses molding to make sound-absorbing foam to form one unit without a glass fiber cloth and stainless steel net to cover the outside of the ducts. This is a very simple facility, but has the same sound eliminating effectiveness. As with the duct covered with glass fiber cloth and stainless steel net, it is suitable for air with high temperature, high flow speed, and high pressure, because it prevents the high speed air from washing out the sound-absorbing material. This simple example is an extension of the present invention which is suitable for air with low temperature and low flow speed.

Figure 6:
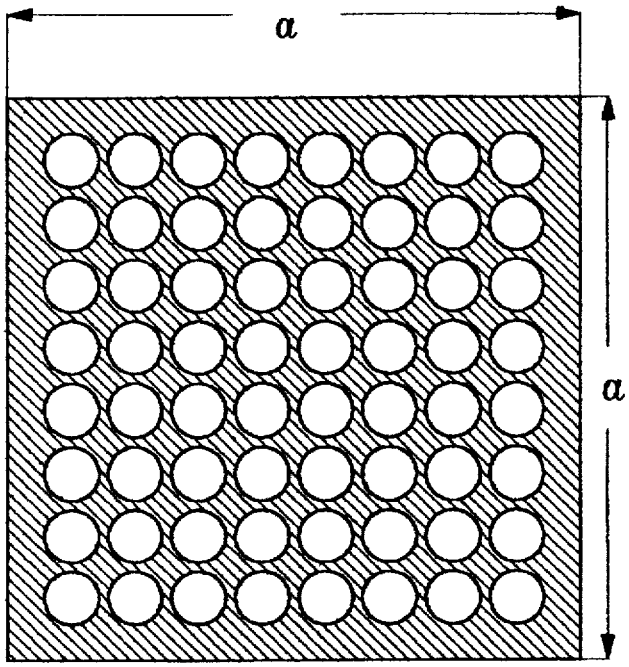
FIG. 6 is a sectional view of an example of a square pipe of the present invention.
Figure 7:
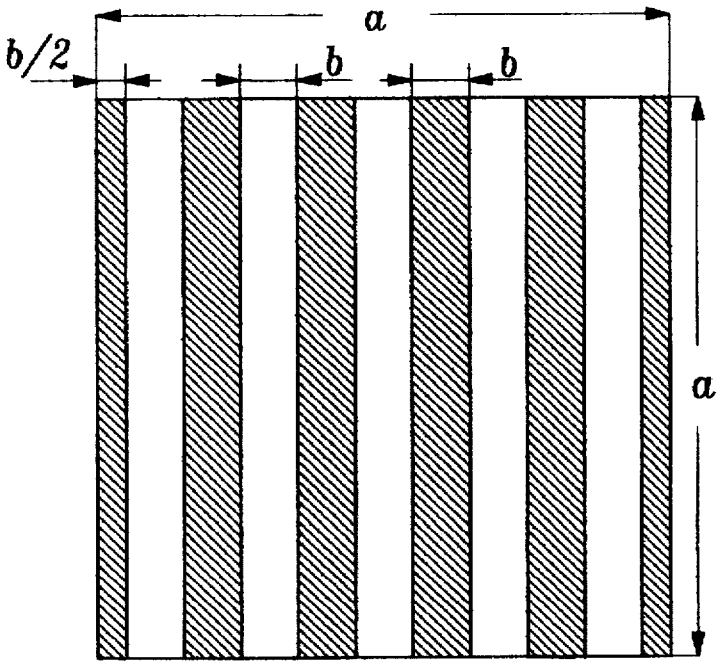
PRIOR ART FIG. 7
FIG. 7 is a sectional view of an example of square pipe of a conventional sound eliminator.
Figure 8:
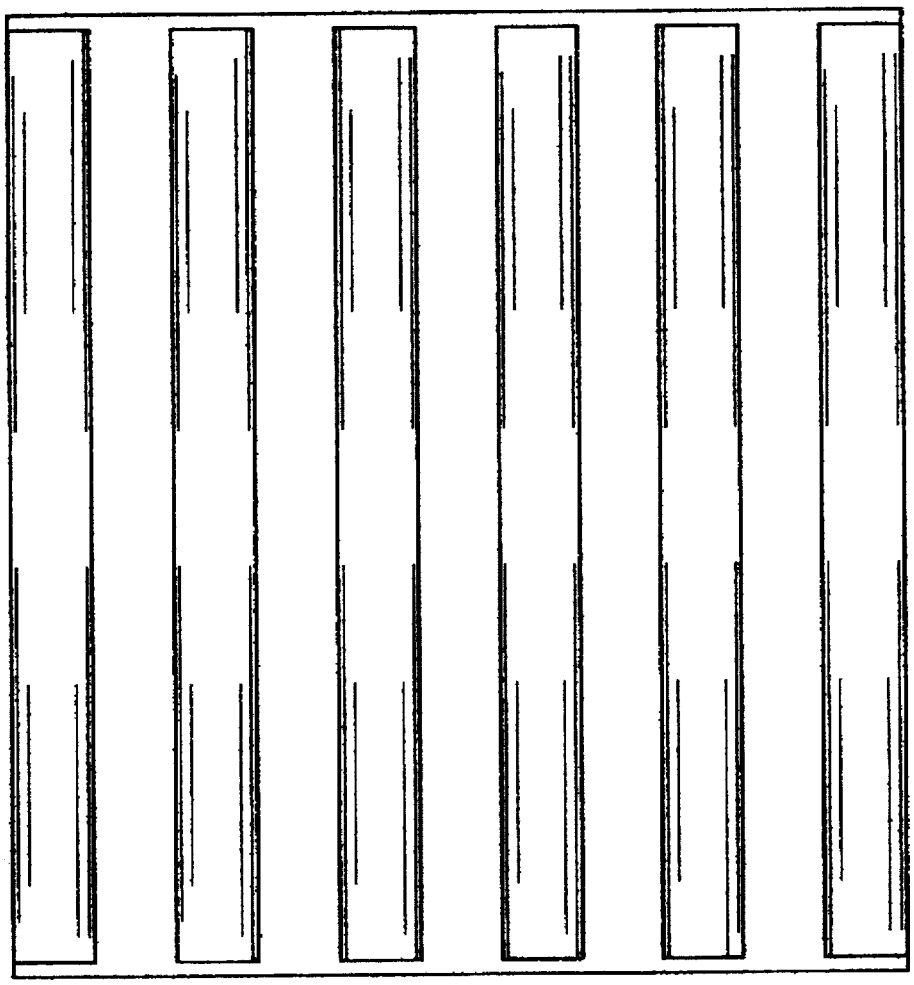
PRIOR ART FIG. 8
FIG. 8 is a sectional view of outer casing of a conventional air pipe.

FIG. 6 and FIG. 7 illustrate the comparison of the present invention and the conventional sound eliminator. Two squares have same side length a. In FIG. 6, a matrix of eight round ducts per side, with b diameter in a square with each side length a to make a 64 air channels. The following calculations will assume the side length a is 100 (around 40 inches), the width b is 10 (around 4 inches), and the length of the sound eliminator is 100 (around 40 inches). FIG. 7 has the same sectional area as FIG. 6, and the thickness of sound-absorbing board on the two sides is half of b each of which is 5 (around 2 inches). The other four sound-absorbing boards are setup in parallel with the air pipe with thickness b to form a five b width air channels. Following is the comparison of the size of the overall surface area in the air channel between the present invention with 64 air channels and the conventional sound eliminator with five air channels in the same sectional area of air channel. The calculation is as follows: set the length, width, and height are 100 (around 40 inches);

The sectional area of air channel of the present invention $$D=10\times10/4\times3.14\times64=5024$$

The sectional area of air channel of the conventional sound eliminator $$D=10\times10\times5=5000$$

The overall circumference of air channel of the present invention $$P=10\times3.14\times64=2009.6$$

The sectional area of air channel of the conventional sound eliminator $$P=10\times10\times5\times2=1000$$

(there is 10 surface between the sound-absorbing cotton and the channel)

The sectional area of sound-absorbing cotton of the present invention is equal to $$100\times100-5024=4976$$

The sectional area of sound-absorbing cotton of the conventional sound eliminator is equal to $$100\times100-5000=5000$$

The overall area of ducts of the present invention is equal to $$10\times3.14\times100\times64=200960$$

The overall area of air channel of the conventional sound eliminator is equal to $$10\times10\times100\times10=100000$$

The quantity of sound-absorbing cotton is equal to the outer casing dimension minus the sectional area of the air channel:

The quantity of sound absorbing cotton of present invention is equal to $$100\times100\times100-5024\times100\ \text{(length)}=497600$$

The quantity of sound-absorbing cotton of the conventional sound eliminator equal to $$100\times100\times100-5000\times100\ \text{(length)}=500000$$

| Item | Present Invention | Conventional sound eliminator | Remarks |
|---|---|---|---|
| Quantity of sound-absorbing cotton | 497600 | 500000 | about the same |
| The overall circumference of air channel | 2009.6 | 1000 | two times difference |
| The section area of air channel | 5024 | 5000 | about the same |
| The overall area of air channel | 200960 | 100000 | two times difference |
| The dimension of outer casing | $100^w \times 100^h \times 100^l$ | same | |

According to the above table, under the same dimension of outer casing, the same quantity of sound-absorbing cotton and the same sectional area of air channel (the air flowing rate), the ratio of the overall circumference of noise flowing (the overall sectional area of air channel) of the present invention is two times higher than the conventional sound eliminator. This is according to the sound eliminating engineering calculation on the noise reduction rate (empirical relation developed by SABINE): $A=12.6\ (P/D)\ \alpha^{1.4}$ A: attenuation, dB/Ft of length (the reduction rate per inch)

P: perimeter of flow area, in (the overall circumference of air channel)

D: flow area, $in^2$ (the overall section area of air)

$\alpha$: random-incidence absorption coefficient in a given frequency band

According to the above formula, the noise reduction rate is direct ratio with P (the overall circumference of air channel), so the noise reduction rate of the present invention is two times that of the conventional sound eliminator. Thus it can be shown, the present invention and the conventional sound eliminator under the same length/width/height, the same quantity of sound-absorbing cotton, and the noise flow through the same sectional area, the noise flowing through an area increased two times, so the noise eliminating effectiveness is higher by two times for the present invention. At the same principle. the sound eliminating effectiveness can be increased more according to the actual requirement.

If the structure of FIG. 7 is modified to have a different sectional area, it uses 8 air channels and nine partition boards (two side boards plus seven partition board), and the width of each channel still is b (10, around 4 inches), and the overall width a still is 100 (around 40 inches). The sectional area of air channel becomes 10×100×8=8000, and the sectional area of sound-absorbing cotton is 100×100−8000=2000, so the noise flow though the surface area of sound-absorbing cotton of the conventional sound eliminator is 100×100=(same length)×16 (is the interface between the sound-absorbing cotton and the air channel)=160000. This value is around 80 percent of the present invention. Thus can be shown, the present invention still has better sound eliminating than the conventional sound eliminator. Compared under multi variable conditions, the overall air flow of the conventional sound eliminator increases 1.6 times, and the quantity of sound-absorbing cotton reduced 40 percent, and the overall touching area is 80 percent of the above mentioned. The previous comparison basis is correct that for the same dimensions of outer casing, the same quantity of sound-absorbing cotton, and the same air flow rate results in a different touching area. Using this comparison method, it can be found that the present invention has a larger touching area and better sound-absorbing rate. If the present invention is setup to have 102 ducts, to have same air flow and the required sound-absorbing cotton is only 20 percent of 64 ducts, and the surface area is 100×3.14×102=320280 which is still two times of the conventional sound eliminator. If four ducts are installed, the diameter of the duct will be 40 (around 16 inches), and under the same sectional area of air channel and the same quantity of sound-absorbing cotton, the overall circumference is 20×3.14×16=1004.8. To correspond with the overall area of air channel, only 50 percent of the above mentioned 64 ducts is close to the conventional sound eliminator. Thus it can be seen that the present invention uses at least 16 ducts width diameter under 20 (around 8 inches)—thus the structure of the present invention will have better effectiveness than the conventional structure.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A multi-duct sound eliminator for an air pipe comprising:

an outer casing;

at least sixteen air ducts in a matrix arrangement;

high density sound- absorbing material filling spaces between the plurality of air ducts in order to absorb intake noise;

each air duct having a plurality of air holes and, a layer of stainless steel net and a layer of glass fiber cloth covering the outside of each air duct to prevent the sound-absorbing material from being washed out by high speed air, wherein the diameter of each duct is less than five inches.

2. The multi-duct sound eliminator for an air pipe as claimed in claim 1, wherein the sound-absorbing material comprises a foam sound-absorbing material.

3. The multi-duct sound eliminator for an air pipe as claimed in claim 1 wherein the sound absorbing material comprises a cotton sound-absorbing material.

* * * * *